United States Patent [19]

Shure

[11] 4,218,195

[45] Aug. 19, 1980

[54] SUBMERSIBLE PUMP

[75] Inventor: Alan Shure, Chicago, Ill.

[73] Assignee: International Components Corporation, chicago, Ill.

[21] Appl. No.: 9,262

[22] Filed: Feb. 2, 1979

[51] Int. Cl.[3] ..... F04B 35/04

[52] U.S. Cl. ..... 417/411; 417/424

[58] Field of Search ..... 417/411, 422, 424

[56] References Cited

U.S. PATENT DOCUMENTS

| | | | |
|---|---|---|---|
| 3,748,066 | 7/1973 | Sully et al. | 417/424 |
| 3,910,725 | 10/1975 | Rule | 417/424 |
| 4,013,383 | 3/1977 | Rule | 417/424 |
| 4,021,150 | 5/1977 | Mabuchi | 417/411 |

*Primary Examiner*—Edward L. Roberts

[57] ABSTRACT

A submersible pump with an on/off switch electrically connecting a rechargeable battery to the motor. An upper sealable compartment contains the battery, recharging connections, and switch with inward projections to position the battery, a recharging receptacle for the battery on the top of the upper compartment, a resilient cover sealing the switch while permitting actuation of the switch from outside of the upper compartment, and a cap sealing the recharging receptacle. A lower compartment houses the motor, pumping chamber, and impeller. A bullet-shaped shell is seated in the lower compartment with a sealing ring between the shell and lower compartment. The motor is disposed in the shell with the motor drive shaft projecting through an opening in the tip of the shell and another seal surrounds the drive shaft between the motor and tip of the shell. The pumping chamber is formed by the annular space between the outside of the shell and the inside of the lower compartment with the impeller mounted on the drive shaft in the bottom of the pumping chamber. The upper compartment and lower compartment are joined together to form a sealed submersible pump.

5 Claims, 8 Drawing Figures

SUBMERSIBLE PUMP

SUMMARY OF THE INVENTION

The present invention involves a rechargeable battery powered submersible pump usable for draining aquariums or other similar functions. Such a pump must be lightweight, compact, inexpensive, and preferably submersible in order to facilitate its use.

In the present invention, the rechargeable battery powered submersible pump has an upper compartment for the battery, a recharging connection for the battery and an on/off switch electrically connecting the battery to the motor. Projections are provided inside the upper compartment to position the battery. A recharging receptacle for the recharging circuit is mounted on the top of the upper compartment and a cap is provided for sealing the recharging receptacle. A resilient cover seals the switch while permitting actuation of the switch from outside of the compartment.

The pump has a lower compartment housing the motor, pumping chamber, and pump impeller. A bullet shaped shell is seated in the lower compartment. A resilient sealing ring is positioned between the seated shell and the lower compartment. The motor is disposed in the shell with a drive shaft projecting through an opening in the tip of the shell. Another resilient seal surrounds the drive shaft between the motor and the tip of the shell. The pumping chamber is formed by the annular space between the outside of the shell and the inside of the lower compartment with the impeller mounted on the projecting drive shaft in the bottom of the pumping chamber.

The upper and lower compartments are joined together to form a sealed submersible pump.

BRIEF DESCRIPTION OF THE DRAWINGS

For a better understanding of the present invention, reference may be had to the accompanying drawings in which.

DESCRIPTION OF THE PREFERRED EMBODIMENT

Figure 1:
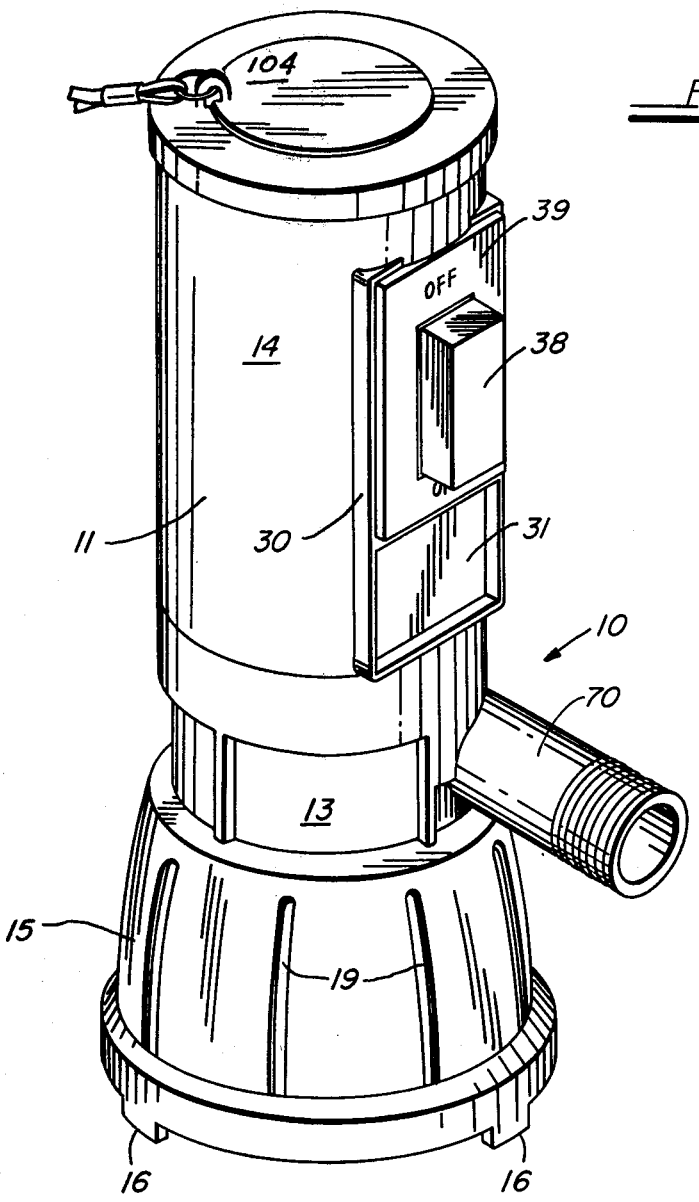
FIG. 1 is a perspective view of a submersible pump embodying my invention.
Figure 2:
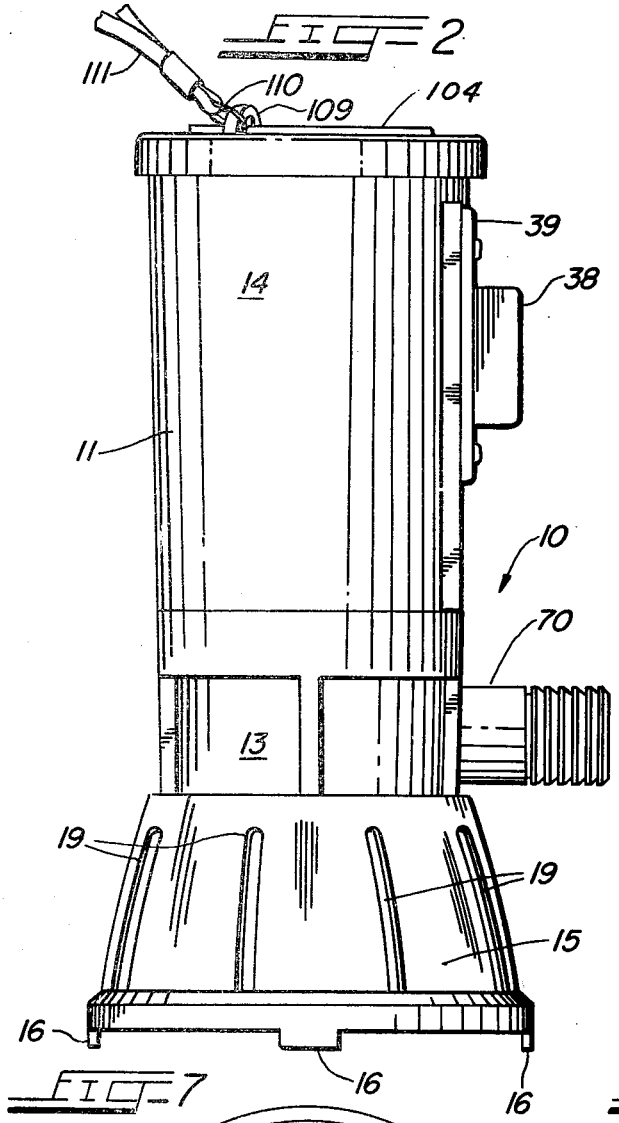
FIG. 2 is a left side elevational view.
Figure 3:
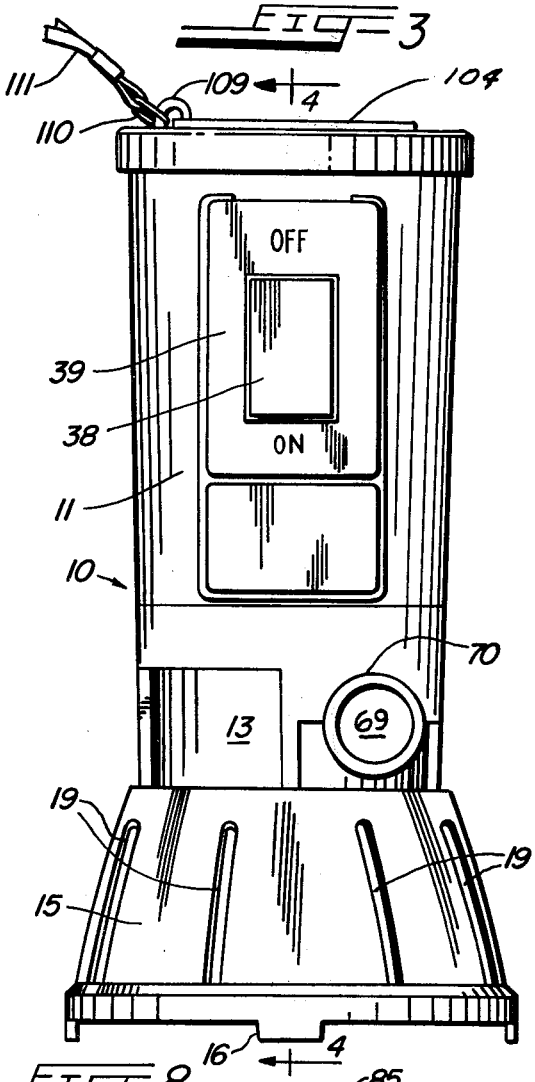
FIG. 3 is a front elevational view.
Figure 7:
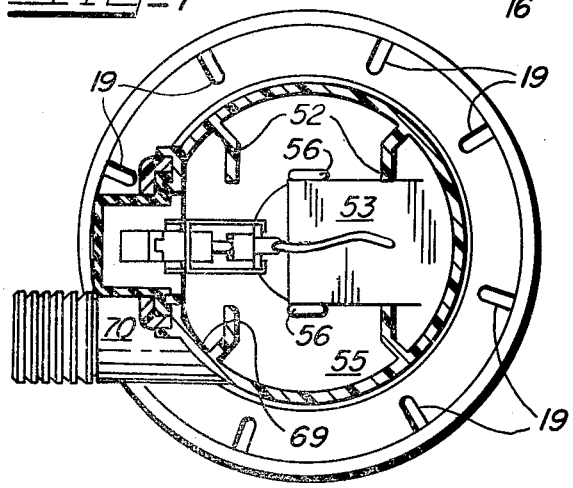
FIG. 7 is a transverse sectional view taken substantially along the line 7—7 of FIG. 4.
Figure 8:
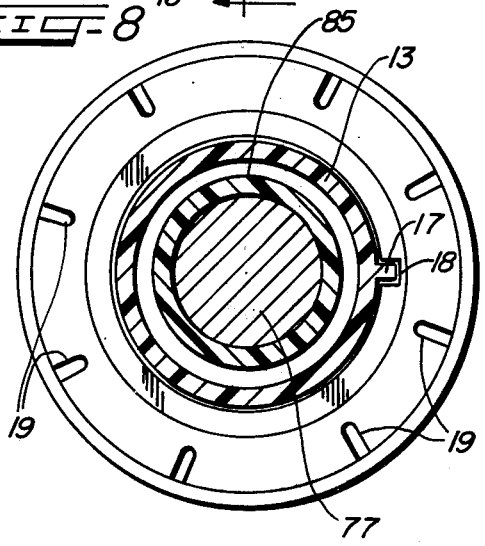
FIG. 8 is a transverse sectional view taken substantially along the line 8—8 of FIG. 4.

Referring now to the drawings in which like parts are designated by like reference numerals in the various views, there is shown in FIG. 1 a submersible pump generally designated by the reference numeral 10. The pump has a housing 11 including a lower compartment 13 and an upper compartment 14.

Figure 4:
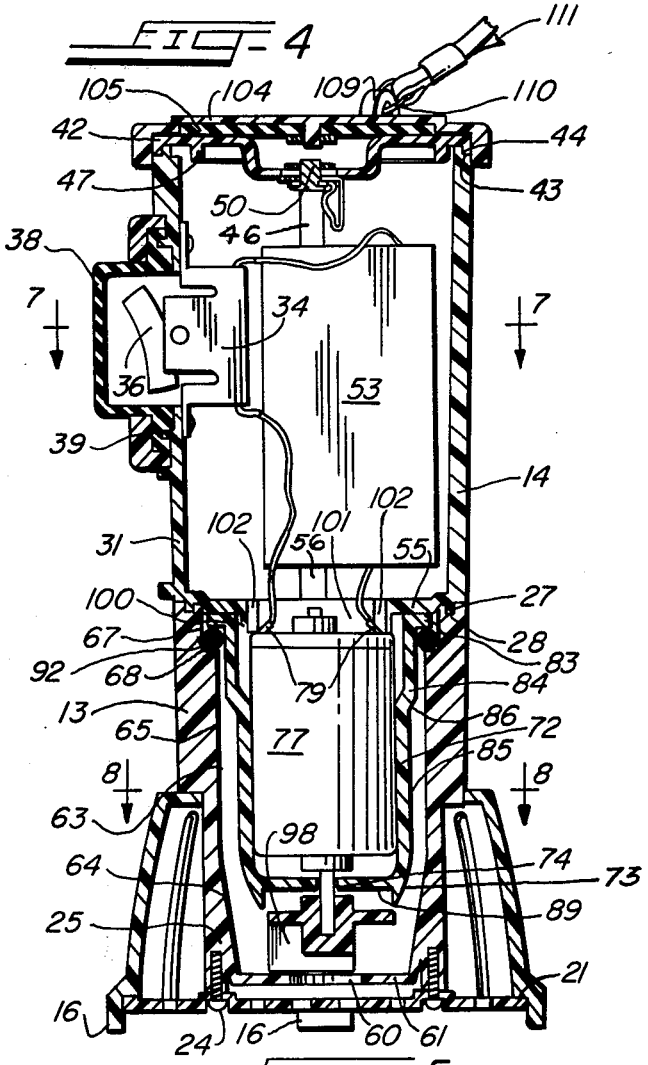
FIG. 4 is a vertical sectional view taken substantially along the line 4—4 of FIG. 3.
Figure 5:
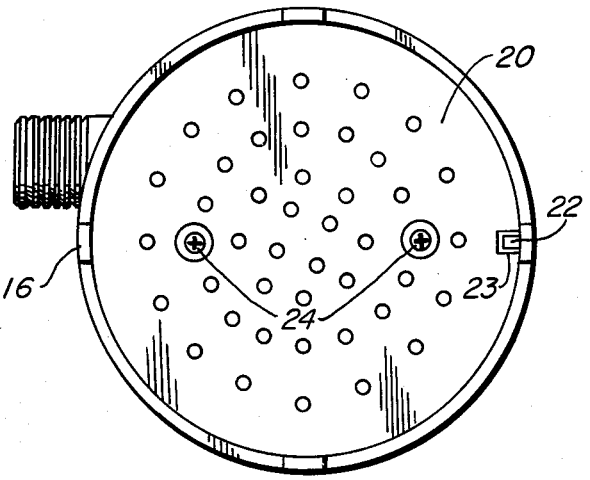
FIG. 5 is a bottom plan view.

Secured to the lower compartment 13 is a bell-shaped base 15 having a number of short spaced legs 16 so that a space remains when the pump is placed on the bottom of an aquarium or other liquid filled enclosure. The base 15 is keyed to the lower compartment 13 for purposes of assembly by means of a projection 17 on the compartment 13 engaging a detent 18 on the bell base. Slots 19 in the side wall of the base permit liquid to readily pass into the bell to avoid any tipping effect that might result from entrapped air making the bell buoyant. A perforated plate 20 is fitted into the bottom of the bell. As is best shown in FIG. 4, the lower part of the bell 15 is formed with a ledge 21 against which the plate 20 fits. Additionally, the plate 20 is keyed to the bell base 15 by a projection 22 on the bottom of the bell engaging a detent 23 in the plate. Screws 24 are secured within bosses 25 provided on the bottom portion of the lower compartment 13 to fasten the plate 20, bell 15, and lower compartment 13 as a subsassembly. The projection 17 and detent 18 are aligned with the projection 22 and detent 23 so that when the plate 20 is inserted into the bottom of the bell, the holes for the screws 24 are aligned with the bosses 25 in the lower compartment 13.

The upper compartment 14 has a downwardly projecting peripheral flange 27 designed to be received within the peripheral groove 28 in the upper part of the lower compartment 13. Upper compartment 14, which is substantially cylindrical, has an integrally molded switch plate 30. The lower portion 31 of the switch plate provides a recess for mounting a name plate or the like. Within the upper area 32 of the switch plate 30, there is provided a rectangular opening 33 for a manually actuable switch 34 comprising a conventional pivoted on/off mechanism having a thumb or finger actuated toggle 36. The switch 34 is secured to the wall of the upper compartment 14 with the toggle protruding outwardly through the opening 33. A rubber, or similarly resilient material that is impervious to liquid, switch cover 38 is positioned over the toggle 36 and retained in place by means of a cover plate 39 that is fitted within the upper recess 32 of the switch plate 30 and secured thereto by means of ultrasonic welding.

The open upper end of the compartment 14 is provided with a top piece 42. An outer peripheral ring 43 on the compartment 14 is engaged by a downwardly projecting lip 44 on the piece 42. Two downwardly depending bosses 46 and an inner downwardly depending flange 47 are also integrally molded on the piece 42. The inner flange 47 has a slot (not shown) that engages a projection on the inside of the compartment 14 (also not shown) to angularly orient the piece 42 with respect to the compartment 14 during assembly. Part of the battery recharging circuitry, including a recharging receptacle 50, is mounted on the top piece 42. The piece 42 is ultrasonically welded to the upper compartment 14.

The upper compartment 14 is also provided with a number of inwardly projecting fins 52 for positioning a conventional rechargeable battery such as that indicated by the reference numeral 53. As is shown in FIG. 4, the bottom or floor of 55 of the upper compartment is provided with a pair of upperwardly projecting bosses 56. As shown in FIG. 4, the battery 53 is also positioned by the bosses 56 and the downwardly depending bosses 46 of the cover 39.

The lower compartment 13 has a central port 60 in the bottom wall 61. The inside side wall 63 has a lower conical portion 64 joining an intermediate cylindrical portion 65 and an upper cylindrical portion 67 having a somewhat greater diameter than the intermediate portion 65 which forms a ledge 68. An outlet opening 69 is formed in the side wall of the intermediate portion 65 and connects with a projecting nozzle 70.

Figure 6:
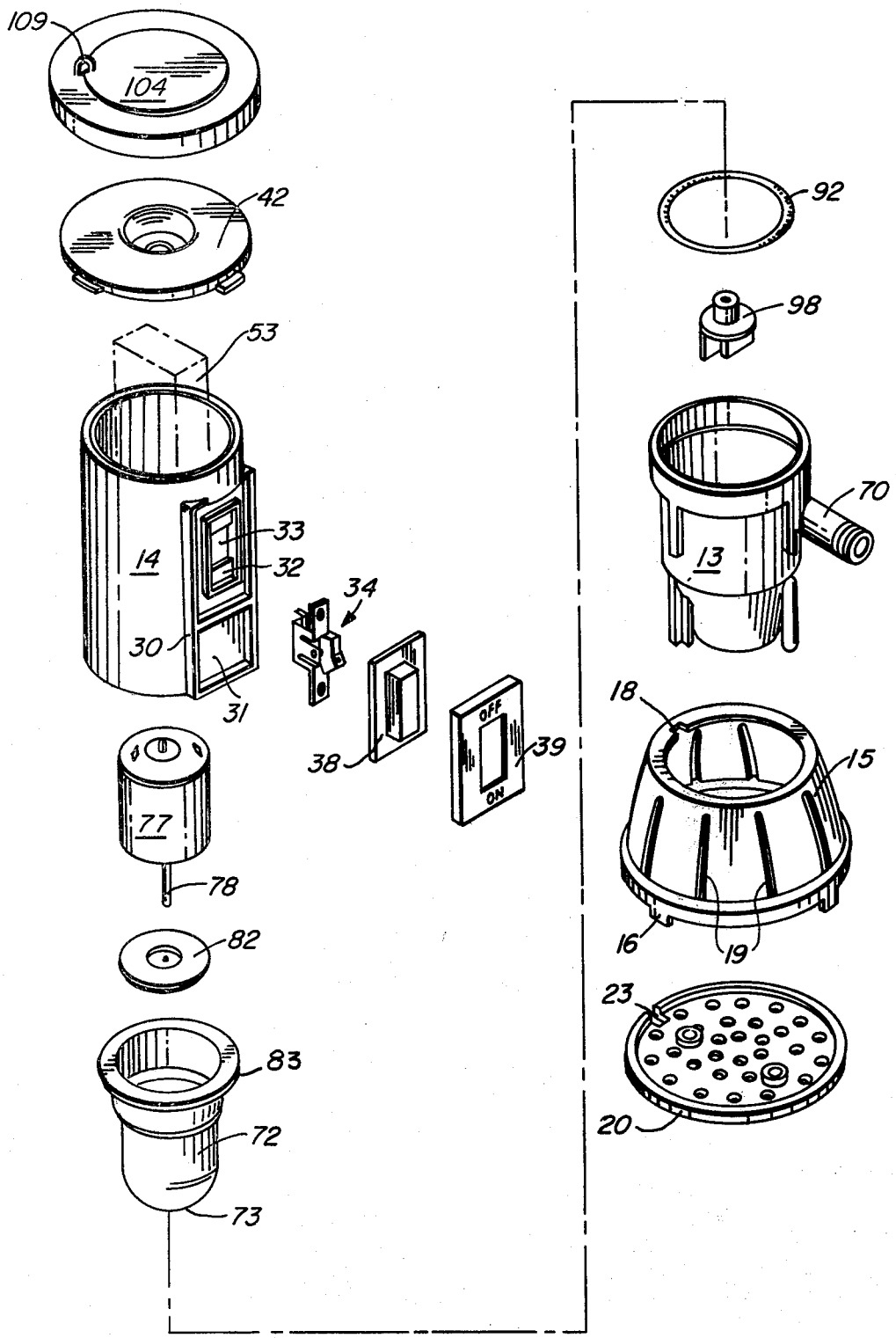
FIG. 6 is an exploded assembly view.

Disposed within the lower compartment 13 is a bullet-shaped shell 72. As is best shown in FIG. 4, the shell has a tip 73 with a central aperture 74. The inside of shell 72 is designed to receive a small low voltage D.C. motor such as 77 having a small diameter keyed drive shaft 78 and upwardly projecting connector tabs 79. The part of the drive shaft near the motor being cylindrical while the free end portion has a flat keying surface. A motor gasket 82, such as is shown in FIG. 6, fits over the cylindrical part of the drive shaft 78 and between the tip 73 and the bottom of the motor 77 to seal the bottom of the motor well formed inside the shell 72 from the entrance of any liquid.

The outer wall of the shell 72 is formed with an outwardly protruding peripheral lip 83, a first cylindrical portion 84, and a second cylindrical portion 85, there being a slight shoulder 86 between the first and second cylindrical portions. The outside of the tip has a recessed flat 89.

The shell 72 is disposed in the lower compartment 13. An O-ring 92 is inserted between the ledge 68 in the lower compartment and the lip 83 of the shell such that when a downward force is exerted on the shell 72, a liquidproof seal is effected by means of the O-ring 92.

The shell 72 is positioned a predetermined distance from the bottom wall 61 of the lower compartment 13. As is best appreciated from FIG. 4, the outer walls of the shell 72 cooperate with the inner walls of the lower compartment 13 to form an efficient pumping chamber 95 for moving liquid from the port opening 60 in the bottom wall to the nozzle 70. An impeller 98 is drivingly affixed to the keyed drive shaft 78 to move the liquid.

In addition to the flange 27 on the upper compartment that fits into the groove 28 at the top of the lower compartment 13, the bottom of the upper compartment 14 has a centered downwardly projecting collar 100. The collar has a principal center opening 101 and notches 102.

When, during initial assembly, the shell 72 is placed within the lower compartment 13, the resiliency of the O-ring 92 tends to bias the top of the lip 83 above the top of the lower compartment 13. Additionally, the motor 77 is biased upwardly by means of the resilient motor gasket 82. Upon placing the upper compartment 14 atop the lower compartmtent 13 and exerting a force thereon, the upper lip 83 of the shell 72 is pushed downwardly compressing the O-ring 92 and effecting a fluidtight seal. Similarly, the collar 100 presses down upon the top of the motor 77 compressing the motor gasket 82 into sealing engagement about the drive shaft 78 and the aperture 74. The downward force exerted upon the motor 77 also helps to prevent rotation of the motor within the motor well. However, rotational movement of the motor is also prevented by the electrical connector tabs 79 on the motor engaging the notches 102.

The pump is also provided with a cap 104 carrying a resilient seal 105 secured to the bottom of the cap. The cap is provided with a number of cammed recesses that engage the projections 107 of the top piece 42. When the cap is placed over the top 42 and rotated so the projections 107 move into engagement with the cam surfaces carried by the cap, the seal 105 is pressed into liquidproof engagement with the upper part of the cover that surrounds the recharging receptacle 50.

The cap 104 may also be provided with an integrally molded link 109 that permits the mounting by means of a split ring 110 of a carrying loop 111.

Thus, it will be seen that when the housing 11 comprising the upper and lower compartments are pressed together and ultrasonically welded with all of the components positioned therein as previously described, and the cap 104 is secured to the top 42, a liquidtight enclosure of the motor, battery, switch, and recharging connection is provided.

While a specific embodiment of the present invention has been shown and described, it will be apparent to those skilled in the art that various changes and modifications may be made without departing from the invention in its broader aspects, and it is, therefore, contemplated in the appended claims to cover all such changes and modofications as fall within the true spirit and scope of the present invention.

What is claimed as new and desired to be secured by United States Letters Patent is:

1. A submersible pump having:

a rechargeable battery power source;

a recharging circuit for said battery;

a motor with a drive shaft;

an on/off switch electrically connecting said battery to said motor;

a pumping chamber, including an inlet and an outlet;

an impeller disposed in said pumping chamber;

an upper sealable compartment having a top end and a lower open end;

said upper compartment containing said battery, said recharging circuit, and said switch;

inwardly projecting means in said upper compartment positioning said battery;

a recharging receptacle for said recharging circuit mounted on said top end;

resilient cover means sealing said switch while permitting actuation of said switch from outside of said upper compartment;

a cap carrying first sealing means engageable with said top end to seal recharging receptacle;

a lower sealable compartment having a bottom end and an upper open end;

said lower compartment housing said motor, said pumping chamber, and said impeller;

a bullet-shaped shell seated in said lower compartment;

second sealing means between the seated shell and said lower compartment;

an opening in tip of said shell;

said motor disposed in said shell with said drive shaft projecting through said opening;

third sealing means surrounding said drive shaft between said motor and said tip;

said pumping chamber comprising an annular space between the outside of said shell and the inside of said lower compartment;

said impeller drivingly mounted on said projecting drive shaft; and said lower open end of said upper compartment and said upper open end of said lower compartment are sealed together.

2. A submersible pump as defined in claim 1 wherein:

a bell-shaped base is secured to said bottom end of said lower compartment;

said inlet for said pumping chamber is positioned in said bottom end;

a perforated plate forms the bottom of said bell-shaped base; and the perforations in said plate are smaller than said inlet in order to screen the inlet against the entrance of any large foreign particles.

3. A submersible pump as defined in claim 1 wherein said upper compartment and said lower compartment are ultrasonically welded together.

4. A submersible pump as defined in claim 1 wherein the outside of said tip of said shell is recessed, said impeller has a hub for receiving said drive shaft and said hub is mounted on said drive shaft substantially within said recess.

5. A submersible pump as defined in claim 1 wherein projections on said motor extend into said upper compartment and engage means on said lower open end of said upper compartment to prevent rotational movement of said motor.

* * * * *